US012546082B2

(12) United States Patent
Kangro

(10) Patent No.: US 12,546,082 B2
(45) Date of Patent: Feb. 10, 2026

(54) GROUND ANCHORING ELEMENT FOR SMALL-BUILDING'S SUBFRAME

(71) Applicant: Jaak Kangro, Tallinn (EE)

(72) Inventor: Jaak Kangro, Tallinn (EE)

( * ) Notice: Subject to any disclaimer, the term of this patent is extended or adjusted under 35 U.S.C. 154(b) by 215 days.

(21) Appl. No.: 18/315,681

(22) Filed: May 11, 2023

(65) Prior Publication Data

US 2023/0366166 A1 Nov. 16, 2023

(30) Foreign Application Priority Data

May 13, 2022 (EE) ..... U202200013

(51) Int. Cl.
*E02D 5/80* (2006.01)

(52) U.S. Cl.
CPC ..... *E02D 5/801* (2013.01); *E02D 2200/11* (2013.01)

(58) Field of Classification Search
CPC ..... E02D 5/801
See application file for complete search history.

(56) References Cited

U.S. PATENT DOCUMENTS 3,222,030 A * 12/1965 Thorpe ..... E04F 15/02452 254/133 R
3,316,680 A * 5/1967 Chrastek ..... E04F 15/02458 52/480
3,704,560 A * 12/1972 Ratliff, Jr. ..... E04G 25/04 52/114
3,831,329 A * 8/1974 Lear ..... E04F 15/02458 248/354.3
3,924,370 A * 12/1975 Cauceglia ..... E04F 15/0247 52/126.6
4,064,668 A * 12/1977 Carter ..... E04B 1/34352 248/188.7
4,404,780 A * 9/1983 Josephson ..... E04B 1/34352 52/126.5
4,458,463 A * 7/1984 Behrend ..... E02D 27/00 248/354.3
5,666,774 A * 9/1997 Commins ..... E04H 12/2253 248/188.4
5,697,191 A * 12/1997 MacKarvich ..... E02D 27/34 52/146
6,796,089 B1 * 9/2004 Campbell ..... E02D 27/02 52/168
8,028,476 B1 * 10/2011 Alford ..... E04H 4/0043 248/188.2

(Continued)

FOREIGN PATENT DOCUMENTS

CN 103891131 A * 6/2014 ..... F24S 23/10
GB 2474234 A 4/2011
WO 2007088376 A1 8/2007

*Primary Examiner* — Joshua K Ihezie
(74) *Attorney, Agent, or Firm* — Koivula & Somersalo, LLC

(57) ABSTRACT

A ground anchoring element for a small-building's subframe allowing the small-building to be stationarily attached to the ground, the anchoring element comprising a bracket, a bracket nut, a threaded rod, adjustment nuts, a support plate with an opening, the threaded rod going through the opening and a tie for the support plate. One end of the threaded rod is in the bracket nut and the other in the ground. The bracket fastened to the subframe of a small-building can be an angled-joint bracket or a straight-joint bracket.

12 Claims, 8 Drawing Sheets

(56) References Cited

U.S. PATENT DOCUMENTS

| | | | | |
|---|---|---|---|---|
| 8,206,063 | B2 * | 6/2012 | Patton | E02D 5/00 405/230 |
| 8,821,073 | B2 * | 9/2014 | Patton | B66F 3/24 52/741.15 |
| 8,844,209 | B1 * | 9/2014 | Oliver | E04B 1/34347 52/157 |
| 2004/0046095 | A1 * | 3/2004 | Pinkleton | E04F 11/00 248/218.4 |
| 2006/0260232 | A1 * | 11/2006 | Crawford | E02D 27/02 52/295 |
| 2009/0272053 | A1 * | 11/2009 | Dent | E04H 12/2261 52/699 |
| 2010/0031587 | A1 * | 2/2010 | Weeks | E04C 3/07 52/126.6 |
| 2012/0117893 | A1 | 5/2012 | Thurner et al. | |
| 2016/0215519 | A1 * | 7/2016 | Bergman | E02D 5/801 |
| 2017/0328023 | A1 * | 11/2017 | Smith | E04H 12/2238 |
| 2023/0366166 | A1 * | 11/2023 | Kangro | E04B 1/34352 |

* cited by examiner

GROUND ANCHORING ELEMENT FOR SMALL-BUILDING'S SUBFRAME

PRIORITY

This application claims priority Estonian Utility Model number U202200013 filed on May 13, 2022, the contents of which is incorporated herein by reference.

TECHNICAL FIELD

This invention belongs in the field of construction, more specifically ground anchoring element fastened to a small-building's subframe.

PRIOR ART

The portable foundation of a building (WO2007088376, Harrison David, John, Edwin, published on 9 Aug. 2007) with its footing member sitting on the ground is known. The footing member comprises a support surface and height adjustment means. The height adjustment means comprises a threaded rod and a nut, and it is fastened to the building with a support section (cantilever). The problem with this solution is that it does not provide any means to anchor the building to the ground.

Also known is a support system that supports a building having I-beam from under the beams (U.S. Pat. No. 4,404,780, Josephson Martin, published on 20 Sep. 1983). The I-beam fastened to the bottom of the building is supported by above-ground piers beneath this. The support system comprises an L-shaped metal clamp (cantilever) with a vertical threaded jack rod beneath it and a building height adjustment screw on top of the pier. The problem with this solution is that it does not provide any means to anchor the building to the ground.

Also known is the foundation screw (US2012117893, Thurner G, Thurner M, Krinner Innovation GmbH, published on 17 May 2012) comprising a threaded rod becoming thinner at the bottom. The foundation screw is inserted into the ground. The in-ground solution does not allow for adjusting the height of the building, e.g. making it level, on the ground.

Considering the technical nature of it, the closest to this invention is the pier foundation for a small-building (GB2474234, Dunster House Ltd., published on 13 Apr. 2011), where a small-building is standing on a plastic grid support base and a support plate attached to the top of the grid. A nut has been welded to the plate; the nut supports a threaded rod extending upwards from the base. The rod is engaged by nuts that support a right angled bracket (cantilever), which can be used to support a small-building. The height of the bracket can be varied by adjusting the position of the nuts. The problem with this solution is that it does not provide any means to anchor the building to the ground.

SUMMARY OF INVENTION

The aim of this invention is to anchor a subframe of a small-building stationarily to the ground. For this purpose, a ground anchoring element is fastened to the small-building's subframe, the ground anchoring element comprising a bracket either with an angled-joint or straight-joint, a bracket nut, a threaded rod, adjusting nuts and a support plate. The support plate has an opening in the middle, and the threaded rod goes through it. One end of the threaded rod is screwed into the bracket nut and the other end is meant for anchoring into the ground. The support plate is attached to the threaded rod with some kind of tie and can move. The ground anchoring element is meant for direct assembly and anchoring of a small-building with a subframe on even or uneven or angled ground and the small-building with the subframe can be levelled on the ground by the ground anchoring element.

DETAILED DESCRIPTION OF THE INVENTION

The disclosed ground anchoring element comprises a support element for the subframe, which are angled brackets with angled joint 1*a* or angled brackets 1*b* and a support element nut permanently attached to the angled brackets, being a bracket nut 2, also a threaded rod 3, adjusting nuts 4, 5 and a support plate 6, whereas the ground anchoring element is to be fastened to a small-building's subframe, which is a framework made of beams on which the small-building rests.

Figure 1:
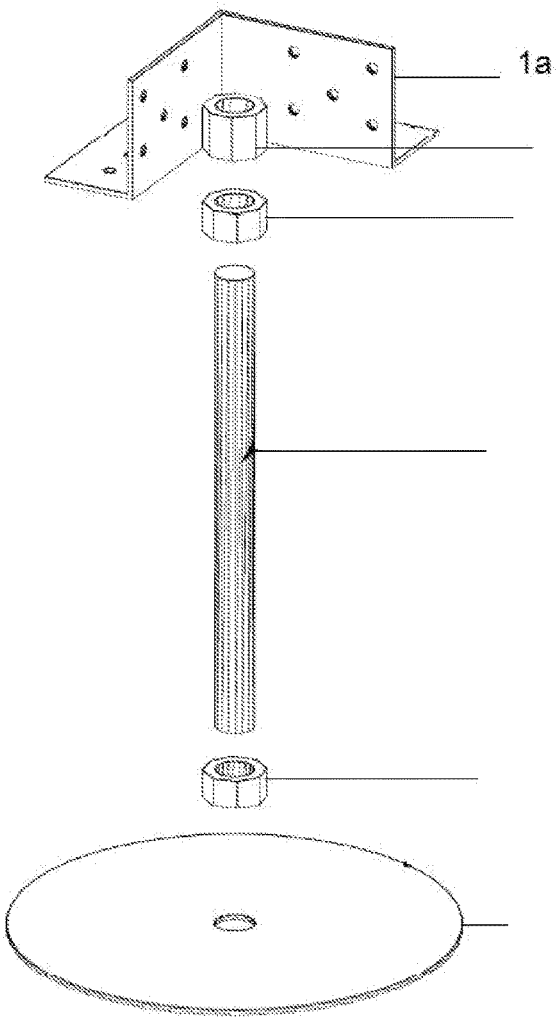
FIG. 1 depicts an embodiment of the ground anchoring element (bracket with angled joint).
Figure 2:
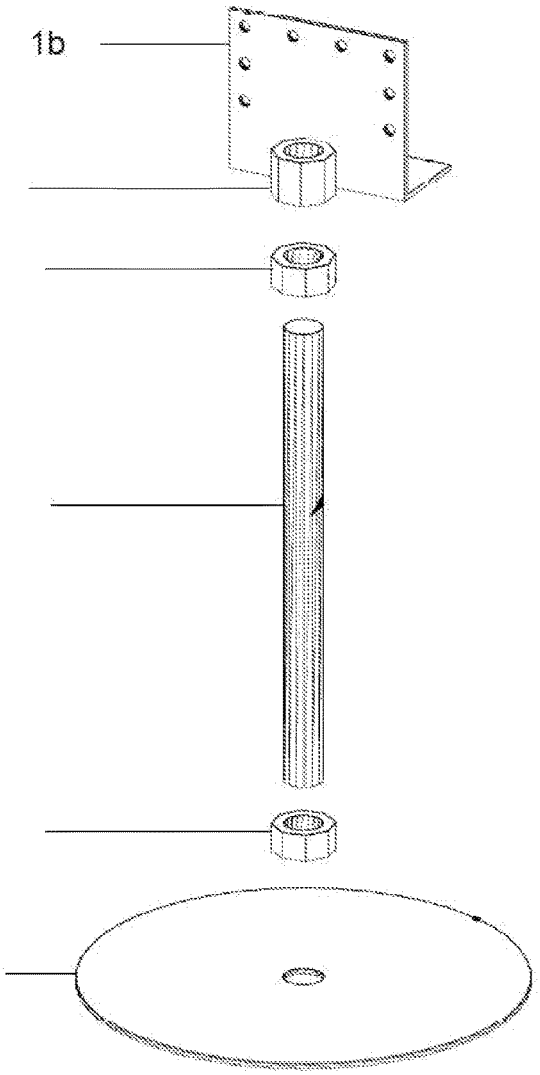
FIG. 2 depicts an embodiment of the ground anchoring element (bracket with straight joint).
Figure 3:
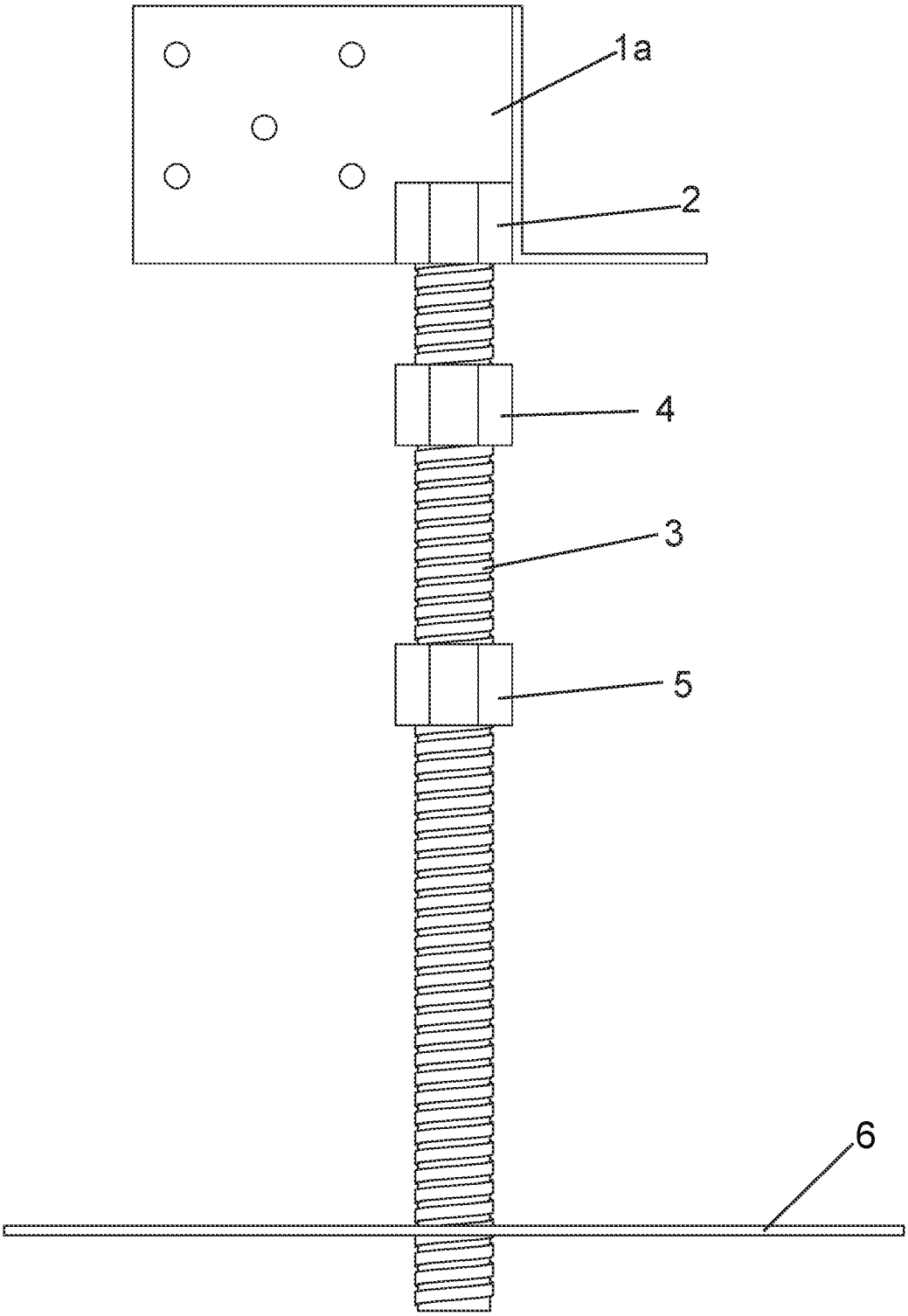
FIG. 3 is a side view of the ground anchoring element with angled joint bracket.
Figure 4:
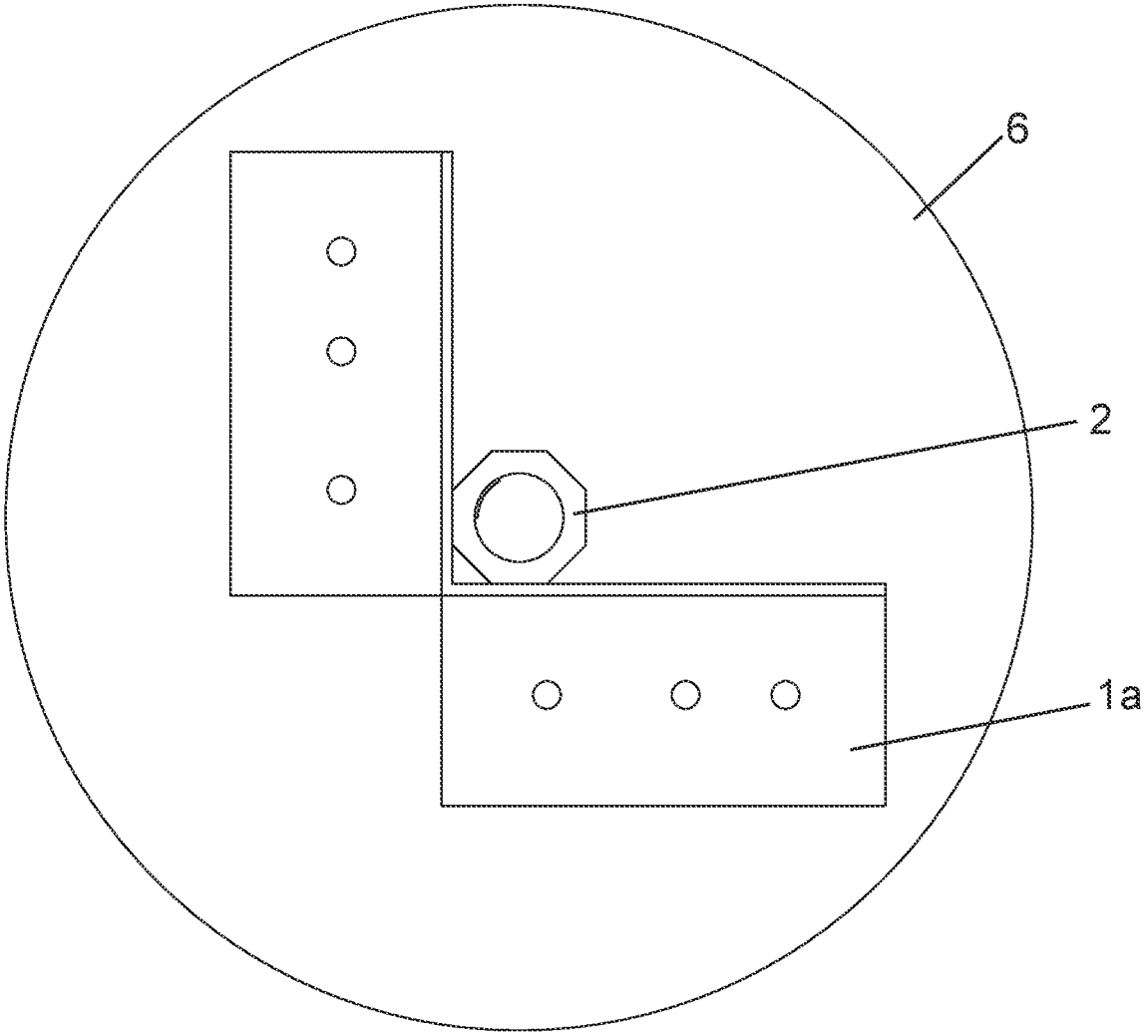
FIG. 4. is a top view of the ground anchoring element with angled joint bracket FIG. 5. shows a bottom view of the support plate.
Figure 5:
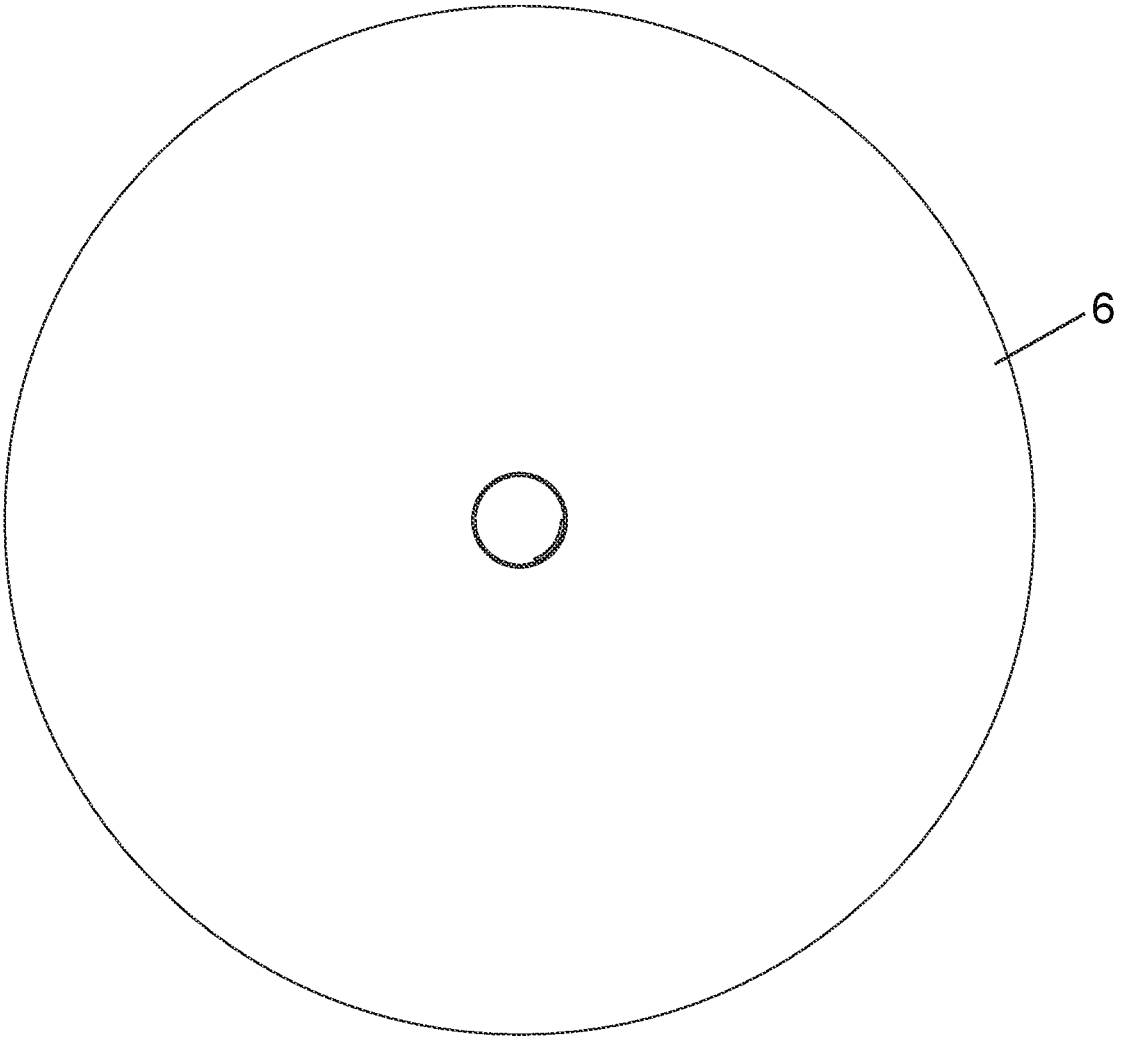
Figure 6:
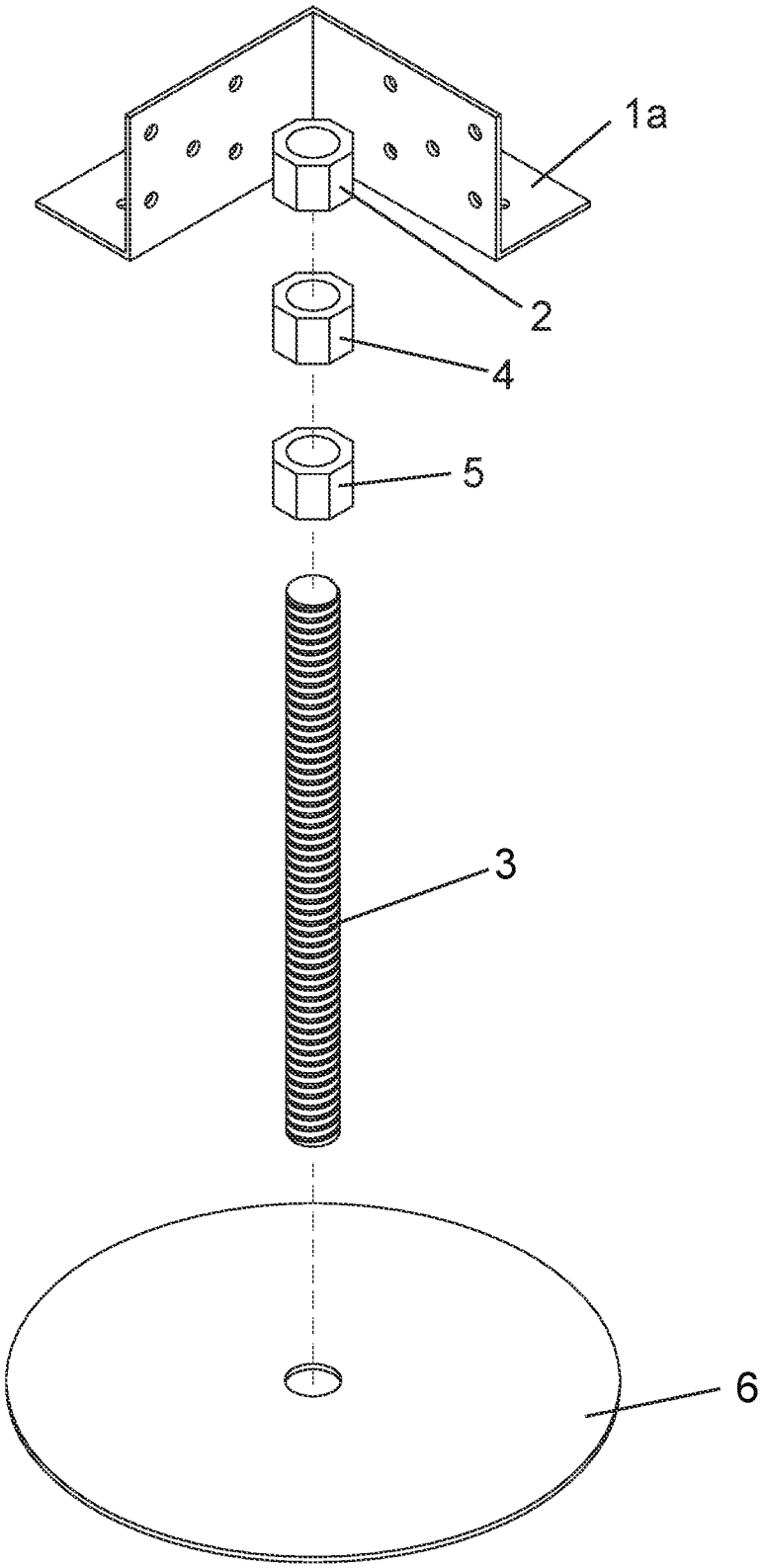
FIG. 6. depicts an exploded view of the ground anchoring element with angled joint bracket.
Figure 7:
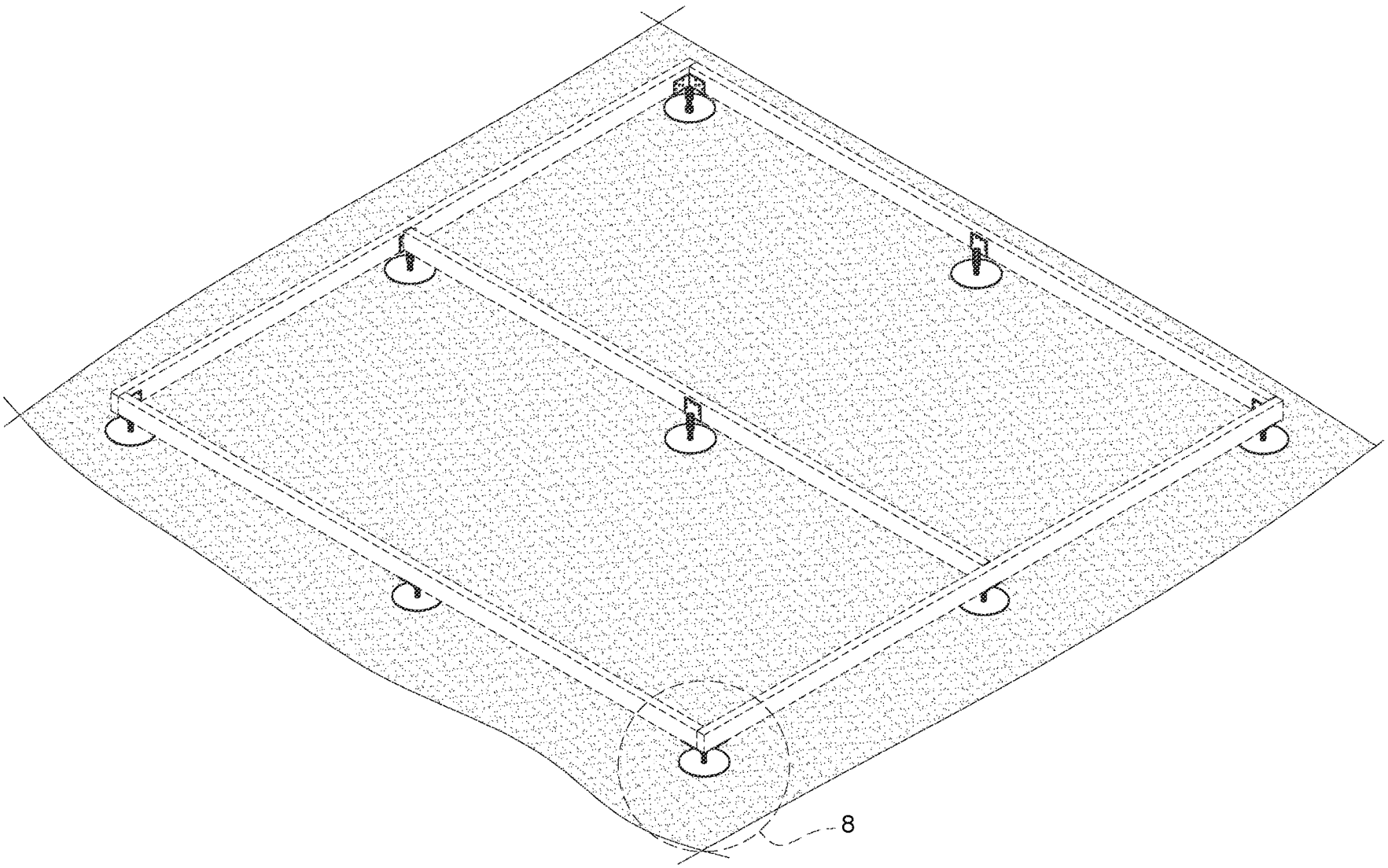
FIG. 7. depicts a subframe of a small-building with ground anchoring elements with angled or straight joint brackets.
Figure 8:
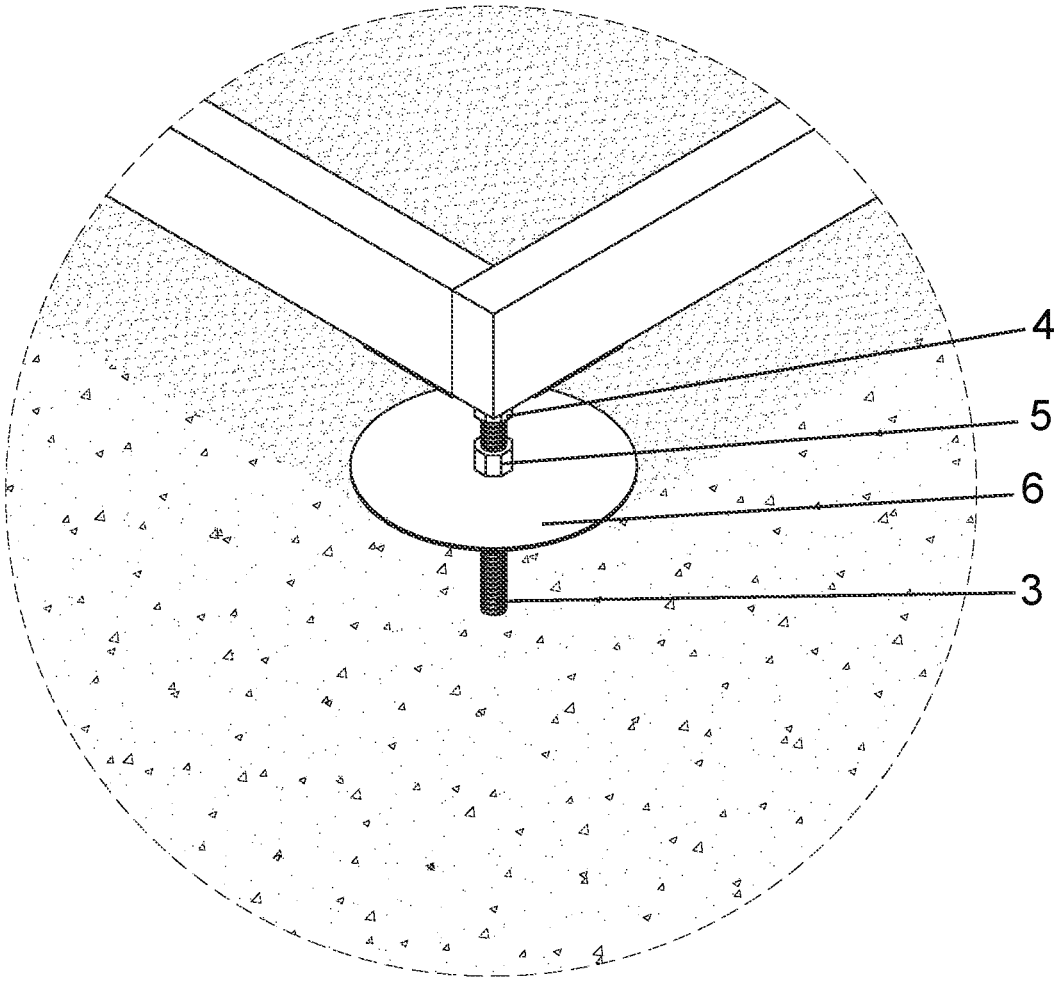
FIG. 8. Is an enlarged view of the circled part in FIG. 7.
Figure 9:
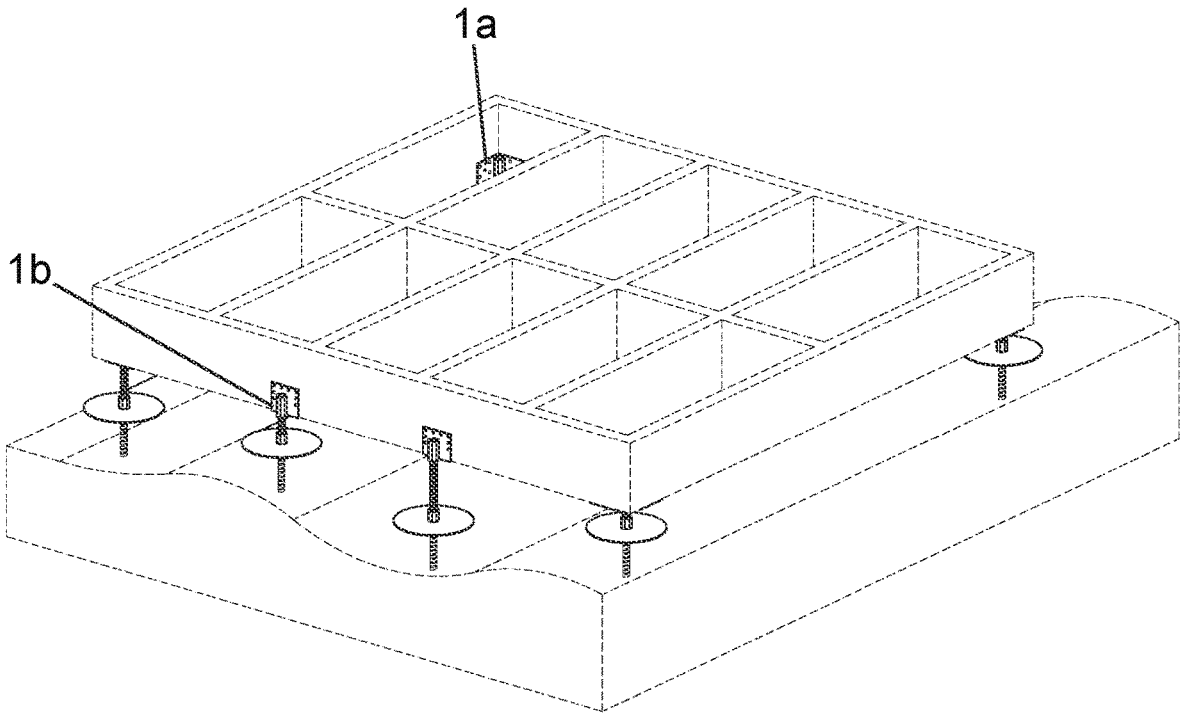
FIG. 9 is another illustration of a subframe of a small-building with ground anchoring elements with angled joint brackets attached to the inner surface of the frame beams and straight joint brackets attached on the outer surface of the beams.

The angled bracket 1*a*, 1*b* is meant to be fastened to the subframe of a small-building, whereas in one embodiment, it has been done with the bracket 1*a* that has an angled-joint (FIG. 1) and, in the other, the bracket 1*b* has a straight-joint (FIG. 2). The angled-joint bracket 1*a* comprises two brackets joined at a right angle.

The angled bracket 1*a*, 1*b* is rectangular (right angled) and connected to the lower part of the subframe (preferably on its inner side) in a way that the beam of the subframe is resting on the bracket. The bracket is perforated and fastened by screws. The bracket is preferably made of metal but also other rigid materials can be used instead.

A bracket nut 2 has been fastened (e.g. welded) to the inner side of the bracket 1*a*, 1*b*. In the event of bracket 1*a*, the bracket nut 2 is fastened at the connecting point of the brackets.

A threaded rod 3 has been inserted into the bracket nut 2, whereas in the beginning, the threaded rod 3 is screwed into the bracket nut 2 in a way that it does not extend out of the bracket nut 2 (towards the sky). Where necessary, the threaded rod 3 can be screwed out of the bracket nut 2 top (to adjust the height of the subframe when installing the small-building). The other end of the threaded rod 3 is for immediate insertion into the ground.

Separate adjustment nuts 4, 5 that can be freely moved have been added to the part of the threaded rod 3 that is below the bracket nut 2.

After the adjustment nuts 4, 5, a support plate 6 with an opening in the middle has been added to the threaded rod 3; the plate can be round disc as well. The support plate 6 is preferably made of metal but also other rigid materials can be used instead.

The support plate 6 is fastened to the threaded rod 3 with a tie, e.g. a cable tie, wire, ribbon, that allows it to move freely. The purpose of the tie (not on the figure) is to keep the support plate 6 on the threaded rod 3 when placing the subframe directly onto the ground and later, to move the support plate 6 on the rod when adjusting the height of the subframe, where necessary.

The angled bracket 1*a*, 1 *b*, the threaded rod 3, the bracket nut 2, the adjustment nuts 4, 5 and the support plate 6 with the tie comprise the footing member of the small-building's subframe (foundation) fastened to a small-building's subframe, which is preferably a framework of wooden beams. The subframe can also be made of other material.

Thus, the disclosed invention is an adjustable in height (to be levelled) and reusable ground anchoring element attached to a small-building's subframe which does not require an even prepared ground surface and foundation in any other way, as it itself is a stationary foundation.

The subframe (foundation) of a small-building is made as follows. A framework is made of beams or a prefabricated subframe is used. Angled bracket 1*a* is screwed to the lower side of the inner corners of the subframe. Where necessary, brackets 1*b* are added to other parts (inner and/or outer) of the subframe. A threaded rod 3 is screwed from below edge of bracket 1*a*, 1*b* into the bracket nut 2 that has been fastened to the bracket 1*a*, 1*b*; the threaded rod 3 is screwed into the bracket nut 2 not through it; the other, long end of the threaded rod 3 is left out of the bracket nut 2. Separate adjustment nuts 4, 5 are screwed onto the threaded rod 3 up to the bracket nut 2, touching it. After the adjustment nuts 4, 5, a support plate 6 is placed, through the opening in the middle, onto the threaded rod 3. The support plate 6 is fastened to the threaded rod 3 with a tie, preferably a cable tie, so that it can move. The use of a tie is necessary because otherwise the support plates 6 would come off the threaded rods 3 when placing the subframe on its place, and when the subframe is on the ground, it must be possible to move the support plates 6 around the threaded rods 3.

When all footing members have been fastened to the subframe, the subframe is put in place on the ground and the ends of the threaded rods 3 that extend outside the nuts 2 are run deep into the ground until the support plate 6 is touching the ground. By running the threaded rods 3 into the ground, the subframe is anchored stationarily to the ground. Holes may be made into the ground for the threaded rods 3 beforehand. An air gap is left between the subframe and ground; it is between the support plate 6, adjustment nuts 4, 5 and the bracket nut 2.

Where necessary, the height of the subframe can be adjusted on the ground, i.e. to lift the subframe higher from the ground and to make it level. This adjustment can be done in two ways: from the ground or from the subframe of the small-building. To adjust the height a little (e.g. to make the building level), adjustment nut 5 is screwed towards the support plate 6. Another option is to screw the adjustment nuts 4, 5 on the threaded rod 3 away from the bracket nut 2, then to screw the adjustment nuts 4, 5 together, and by screwing these simultaneously on the threaded rod 3, the threaded rod 3 will turn in the bracket nut 2. As the support plate 6 is on the ground and the threaded rod 3 is stationary in the ground, this activity will either lift or lower the subframe.

The final step is to place the small-building onto the subframe.

List of Elements

1*a* bracket (angled joint bracket)
1*b* bracket (straight joint bracket)
2 bracket nut
3 threaded rod
4, 5 adjustment nuts
6 support plate

The invention claimed is:

1. A ground anchoring element for a small-building's subframe, wherein the ground anchoring element is configured to be fastened to a small-building subframe, which is a framework of beams, and the ground anchoring element comprises a support element and a support element's nut for the subframe, a threaded rod, adjustment nuts, and a support plate, wherein:

the support element is an angled bracket having a vertical and a horizontal part, and being configured to be placed on a lower part of the subframe;

the support element's nut is a bracket nut being rigidly fastened from its perimeter to the vertical part of the angled bracket;

the bracket nut is configured to accommodate one of the ends of the threaded rod;

the adjustment nuts and the support plate are configured to be placed onto the threaded rod and the adjustment nuts are freely movable along the rod between the bracket nut and the support plate;

the support plate has an opening in the middle and the threaded rod is configured to go through the opening of the support plate;

the support plate is configured to be fastened to the threaded rod with a tie allowing the support plate to move;

a lower end of the threaded rod is configured to run directly into the ground; and a height of the subframe on the ground is adjustable and levelled with the ground anchoring element.

2. The ground anchoring element for a small-building's subframe according to claim 1, wherein the angled bracket is an angled-joint bracket, wherein two angled brackets are joined at a right angle.

3. The ground anchoring element for a small-building's subframe according to claim 1, wherein the angled bracket is a straight-joint bracket.

4. The ground anchoring element for a small-building's subframe according to claim 1, wherein the angled bracket is configured to support a beam of the subframe and the angled bracket is configured to be fastened to the beam with screws.

5. The ground anchoring element for a small-building's subframe according to claim 1, wherein the support plate is a plate or disc.

6. The ground anchoring element for a small-building's subframe according to claim 2, wherein the ground anchoring element is configured to be attached to the subframe with the angled-joint bracket.

7. The ground anchoring element for a small-building's subframe according to claim 3, wherein the ground anchoring element is configured to be attached to the subframe with the straight-joint bracket.

8. A multitude of ground anchoring elements for a small-building's subframe according to claim 1, wherein the multitude comprises ground anchoring elements having angled-joint brackets and ground anchoring elements having straight-joint brackets.

9. The ground anchoring element for a small-building's subframe according to claim 2, wherein the bracket is an angled joint bracket configured to be fastened to an inner lower part of the subframe.

10. The ground anchoring element for a small-building's subframe according to claim 3, wherein the angled bracket is a straight-joint bracket configured to be attached to an inner lower part of the subframe.

11. The ground anchoring element for a small-building's subframe according to claim 2, wherein the angled bracket is an angled joint bracket configured to be attached to an outer lower part of the subframe.

12. The ground anchoring element for a small-building's subframe according to claim 1, wherein the subframe with the ground anchoring element is configured to be directly assembled on even, uneven or angled ground.

* * * * *